US005494420A

United States Patent [19]

Mawhirt et al.

[11] Patent Number: 5,494,420

[45] Date of Patent: Feb. 27, 1996

[54] ROTARY AND RECIPROCATING PUMP WITH SELF-ALIGNING CONNECTION

[75] Inventors: James A. Mawhirt, Brooklyn; Jack M. Olich, Mahopac; Mark Huza, Mount Vernon, all of N.Y.

[73] Assignee: Diba Industries, Inc., Danbury, Conn.

[21] Appl. No.: 250,538

[22] Filed: May 31, 1994

[51] Int. Cl.[6] ..... F04B 7/06

[52] U.S. Cl. ..... 417/500; 417/DIG. 1; 417/499

[58] Field of Search ..... 417/500, 499, 417/492, DIG. 1; 92/DIG. 4, 29

[56] References Cited

U.S. PATENT DOCUMENTS

| | | | |
|---|---|---|---|
| 2,981,573 | 4/1961 | Retuer | 417/DIG. 1 |
| 3,266,432 | 8/1966 | Wortley | 417/492 |
| 3,382,812 | 5/1968 | Smith | 417/500 |
| 3,972,655 | 8/1976 | Tsunematsu et al. | 417/500 |
| 4,008,003 | 2/1977 | Pinkerton | 417/492 |
| 4,476,835 | 10/1984 | Laufer | 417/500 |
| 4,708,605 | 11/1987 | Orlita | 417/500 |
| 5,017,157 | 5/1991 | Pinkerton | 417/500 |
| 5,081,910 | 1/1992 | D'Ascenzo, Jr. | 92/DIG. 4 |
| 5,158,441 | 10/1992 | Aid | 417/500 |

*Primary Examiner*—Richard A. Bertsch
*Assistant Examiner*—Ted Kim
*Attorney, Agent, or Firm*—William L. Freeh

[57] ABSTRACT

A self-aligning connection between a rotary and reciprocating pump piston allows relative radial movement between the pump piston and the rotary cam. The self-aligning connection is formed by a pin carried by the rotary cam and is positioned in a radial recess located in the pump piston. An improved drive for the rotary cam is perfected by a cam follower pin supported from the housing by a roller bearing race which is pressed fitted within a bore formed by the pump housing. The pump piston abuts a TEFLON pad located in the pump cylinder to reduce dead space and insure that the pump produces accurate volumes. The employment of different plastic materials between the rotary cam and the pump housing provides an improved bearing surface.

7 Claims, 2 Drawing Sheets

FIG. 3
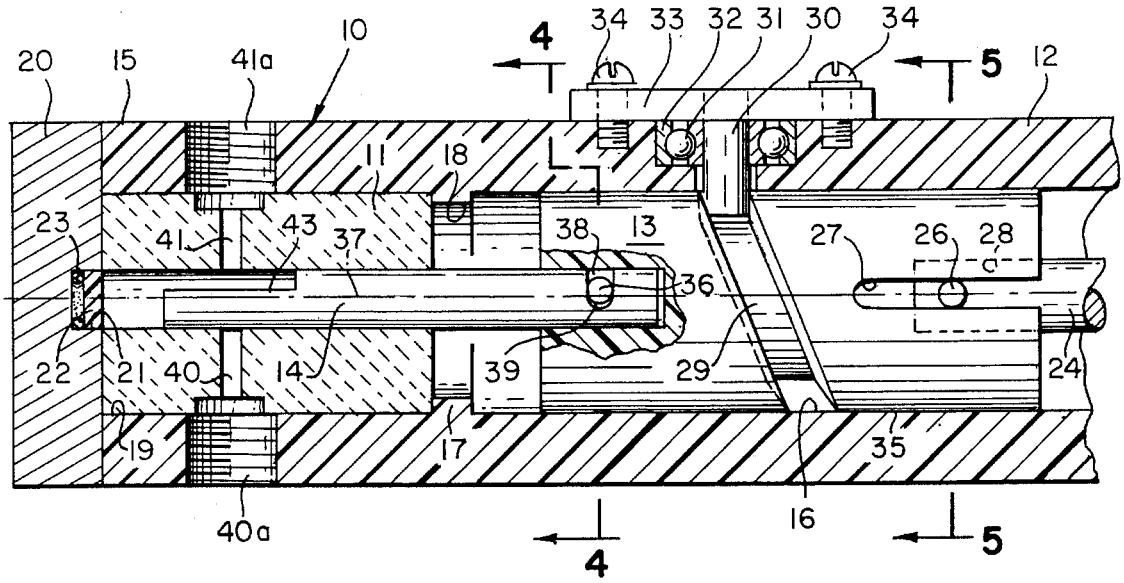
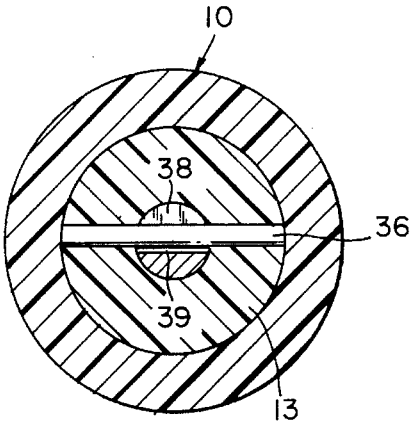
FIG. 4
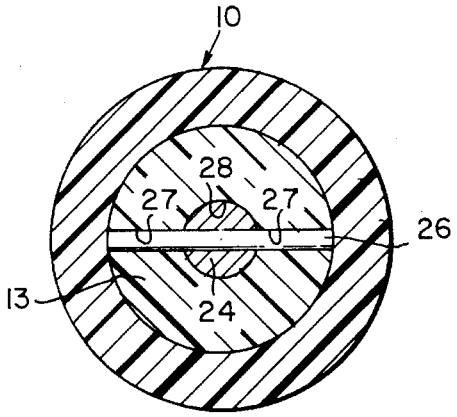
FIG. 5

ROTARY AND RECIPROCATING PUMP WITH SELF-ALIGNING CONNECTION

OBJECTS OF THE INVENTION

The present invention has, for one of its principal objects, a self-aligning connection between a rotary and reciprocating valveless pump piston and a rotary cam.

Another object is to provide a rotary and reciprocating valveless pump piston with a reduced dead space.

A further object is to provide a rotary and reciprocating pump piston with an improved rotating cam follower pin attachment to the pump housing.

Another further object is to extend a motor drive shaft into a bore formed by a rotary cam to provide a predetermined clearance between the motor driveshaft periphery and the rotary cam bore.

Another object is to provide a rotary and reciprocating pump piston which is resistant to wear.

A still further object is to provide an improved bearing surface between the periphery of the rotary cam and the pump housing.

SUMMARY OF THE INVENTION

According to the invention, a self-aligning connection is formed between a rotary and reciprocating pump piston and a rotary cam. The self-aligning connection is formed by a pin carried by the rotary cam and a recess formed by the piston, the radial recess allowing relative movement between the rotational axes of the rotary cam and the rotary and reciprocating pump piston.

An improved bearing surface between the rotating cam and the pump housing is formed by different plastic materials to produce a self-lubricated bearing surface.

Axial movement of the rotary cam is effected by a pin attached to the pump housing and extending into a helical groove formed on the periphery of the rotary cam. The pin is supported by a roller bearing having an outer face that is press-fitted into a bore formed by the pump housing.

The dead space between the pump piston is reduced by locating a TEFLON pad in the pump end cap and allowing the pump piston to contact the TEFLON pad in its dead center position.

The various features which characterize the invention are pointed out with particularity in the annexed claims. For a better understanding of the invention, its operating advantages and specific objects attained, reference is made to the accompanying drawings and descriptive matter in which a preferred embodiment is disclosed.

BRIEF DESCRIPTION OF THE DRAWINGS

FIG. 3 is a sectional view of the pump piston along a vertical plane of the pump illustrated in FIG. 1;

FIG. 4 is a sectional view along line 4—4 of FIG. 3 and

FIG. 5 is a sectional view along line 5—5 of FIG. 3.

DETAILED DESCRIPTION OF THE PREFERRED EMBODIMENT

Figure 1:
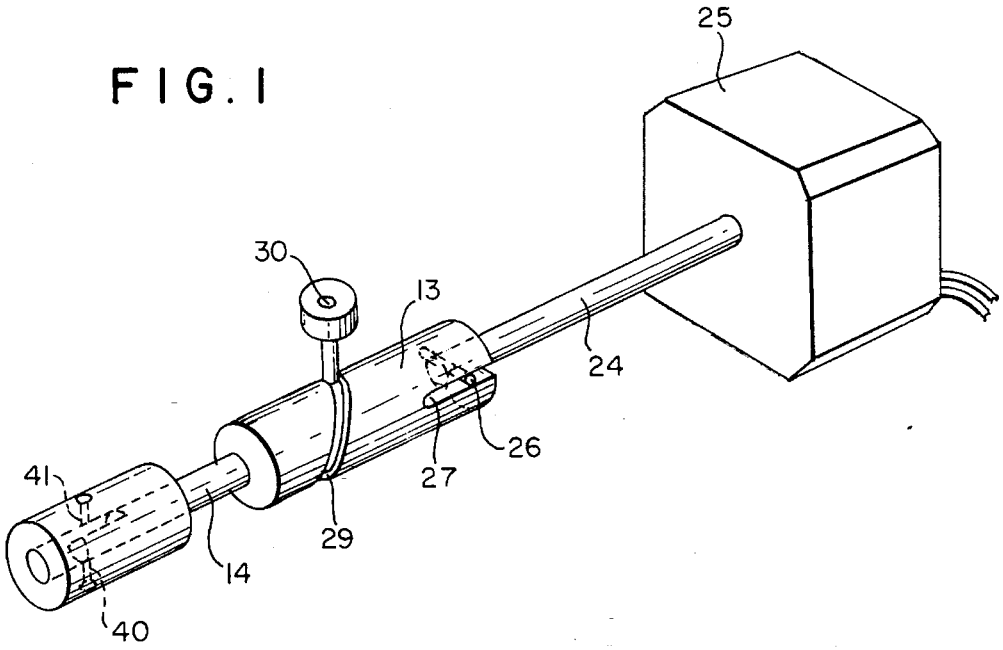
FIG. 1 is a perspective view of the rotating cam, the rotary and reciprocating pump piston and the motor drive.

As is evidenced from the drawings, the pump is located within a plastic housing 10. More particularly, the housing is fabricated from a plastic material marketed under the trade name of Delrin 150. An actuating end 12 of the housing contains a rotating cam 13. A pump piston 14 is disposed in the pumping end 15. The housing is provided with a first bore 16 extending from the actuating end 12 to a step 17 formed by bore 16 and a second bore 18. A third bore 19 is formed at the housing pumping end 15. A ceramic sleeve or cylinder block 11 is located within bore 19 and abuts the step 17. Two dowel pins (not shown) are located between the periphery of the ceramic sleeve and the housing pump end 15 to position the ceramic sleeve within the pump housing.

An end cap 20, attached to the housing by any known attachment means, forces the ceramic sleeve 11 against step 17. The cap 20 is recessed at 21 to accommodate a TEFLON pad 22. An O-ring 23 located between the TEFLON pad and the rear wall of recess 21 positions the TEFLON pad 22 at a predetermined position with respect to the pumping end of the pump piston 14. More specifically, the end face of the TEFLON pad 22 is disposed in a plane which is coincident with a plane formed by the left end of the ceramic sleeve 11 and the right side of the end cap 20 (FIG. 3)

The TEFLON pad 22 is fixed within end cap recess 21 by any suitable means such as a screw between end cap 20 and the TEFLON pad 22, an interference fit between the TEFLON pad 22 and the pump housing 10 or by placing adhesive on axially opposite sides of O-ring 23. When the piston 14 reaches the end of its discharge stroke, the piston abuts the TEFLON pad 22. This construction reduces the dead space at the end of the discharge stroke and effects a pump which produces very predictable pump volumes or outputs.

A drive shaft 24 extends from a motor 25. The drive shaft 24 is apertured to receive a pin 26. A blind bore 28 at the axial end of the rotary cam 13 provides a space for the end of the drive shaft 24. To stabilize the motor drive and prevent piston-rotary cam vibration, a clearance of 0.010 to 0.012 inches is provided between the drive shaft 24 and the rotary cam blind bore 28. Rotary motion of the cam is effected by notches 27 formed at the end of the cam 13. The pin 26, carried by the drive shaft 24, engages the cam-formed notches 27 (FIG. 5). The lengths of the notches 27 and the blind bore 28 are greater than piston stroke or displacement, preferably the length being not less than one and one half times the piston stroke.

The cam 13 is fabricated from a plastic sold under the trade name of TURCHITE. A helix groove 29 is formed on the periphery of rotary cam 13 and a follower pin 30 extends into the helix groove 29. A press-fit between the outer race 32 and a bore formed by the pump housing 10 provides for the support of the follower pin. The roller bearing 31 and the follower pin are protected from dirt and the environment by a cover 33 attached to the pump housing 10 by screws 33. The plastic pump housing 10, fabricated from DELRIN 150, and the TURCHITE plastic cam 13 cooperate to form a self-lubricated bearing surface 35 between the rotary cam 13 and the pump housing bore 16.

A self-aligning connection is formed between the rotary cam 13 and the rotary and reciprocating piston 14 by a retaining pin 36 positioned within piston-formed recesses 38 and 39.

The retaining pin 36 is affixed to the rotary cam by apertures located on diametrically disposed locations of the rotary cam 13 (FIG. 4). The retaining pin is attached to the cam by an interference fit. As illustrated in FIGS. 3 and 4, the retaining pin 36 is radially offset with respect to a rotational axis 37 which is common to the rotational axes of both the rotary cam 13 and the rotary and reciprocating piston 14. The pin position produces spaces 38 and 39 located above and below the retaining pin 36 (FIG. 4). Any misalignment between the rotational axes of the rotary cam and the rotary and reciprocating piston 14, caused by wear or improper design tolerances, is compensated for by the pin moving radially in spaces 38 and 39. The piston is fabricated from ceramic and closely fitted within the pump cylinder bore by radial clearances of from 0.002 to 0.004 inches.

A chordal flat 43 is formed on the pumping end of piston 14. An inlet is formed below the piston by a fitting 40*a* and an inlet port 40. Fluid is discharged from the pump chamber by an outlet port 41 and a fitting 41*a* located above the piston 14.

Figure 2:
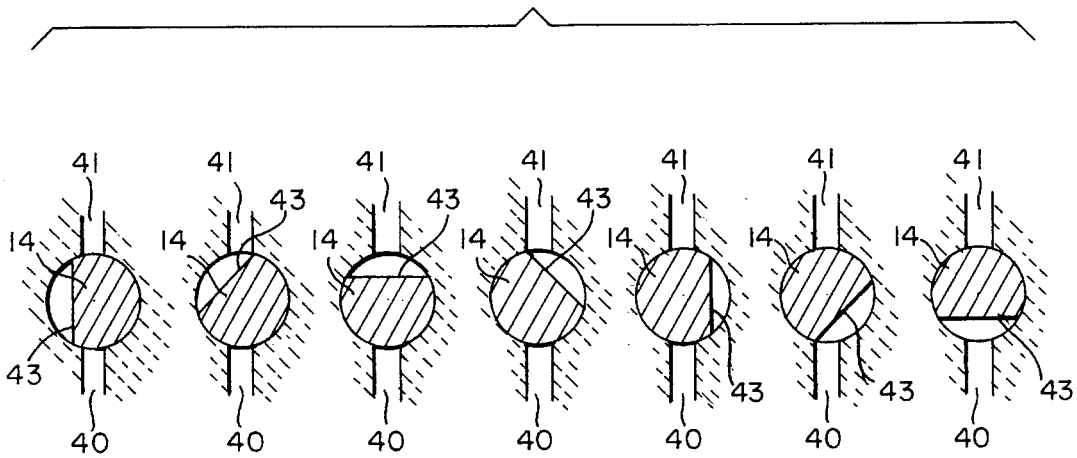
FIG. 2 illustrates the relative positions between the pump inlet and outlet ports and the piston formed chordal flats at seven different piston positions.

As illustrated in FIG. 2, the chordal flat 43 simultaneously closes both the inlet and outlet passages 40 and 41 at the beginning of both the discharge and suction stroke positions (positions 1 and 5 of FIG. 2). The discharge stroke begins with the piston at its maximum volume and withdrawn position (the left-most position of FIG. 1) and the pump chamber completely filled with fluid. As the cam 13 rotates and effects rotation and reciprocation of the pump piston 14, the pump piston moves towards the cover 20 reducing the volume of the pump chamber and discharging fluid from the pump chamber by the chordal flat 43 closing the inlet passage 40 and opening discharge port 41. After rotating 180 degrees the piston reaches its outer dead center position as the piston face contacts TEFLON pad 22. The volume of the pump chamber increases immediately after the pump reaches its outer dead center position. Because of a volume increase immediately after the outer dead center position, a suck back is effected after the pump piston passes through the outer dead center position. The suck back occurs between positions 5 and 6 of FIG. 2.

The above described pump is very resistant to wear. The subject pump was subjected to tests of ten million pump cycles. Inspection of the pump piston surfaces as well as the self-lubricated bearing surface between the rotary cam 13 and the pump housing 10 demonstrated very little evidence of wear at these critical wear surfaces.

While a specific embodiment of the invention has been described to illustrate the principles of the invention, it will be understood that the invention may be embodied otherwise without departing from these principles.

What is claimed is:

1. A positive displacement valveless pump comprising;

a housing for a rotating cam and a rotary and reciprocating piston, the rotary cam and rotary and reciprocating piston each having a rotational axis, an inlet port and an outlet port in the housing communicating with a cylinder in which the rotary and reciprocating piston is located, said piston and cylinder forming a variable volume pumping chamber;

a notch formed at one axial end of said rotating cam, an annular endless groove located on the periphery of the rotating cam;

a pin carried by a driveshaft and operatively connected to said notch to effect rotation of said rotary cam;

a follower pin attached to the housing and extending into the annular groove to effect reciprocation of said rotary cam and a self-aligning connection between the rotary cam and the rotary and reciprocating piston whereby, during the inlet cycle, the piston opens the inlet port and closes the outlet port as the pump chamber volume increases and, during the discharge cycle, the piston closes the inlet port and opens the discharge port as the pumping chamber volume decreases, said self-aligning connection formed by a pin and being located adjacent the rotational axes of the rotary cam and the rotary and reciprocating piston to allow for radial movement between the rotational axes of the rotary cam and the rotary and reciprocating piston.

2. A positive displacement valveless pump as set forth in claim 1 wherein the self-aligning connection is formed by a substantially radially extending pin attached to the rotary cam and a recess formed by the rotary and reciprocating piston, said pin being offset relative to the rotational axes of both the rotary cam and the rotary and reciprocating piston and being capable of radial movement within said recess.

3. A positive displacement valveless pump as set forth in claim 1 in which an O-ring and a TEFLON pad is located at the end of the pump cylinder and is contacted by the piston in its dead center position.

4. A positive displacement valveless pump as set forth in claim 1 and a self-lubricated plastic bearing between the periphery of the rotary cam and the pump housing, the bearing being formed by a plastic cam fabricated from TURCHITE and a pump housing fabricated from DELRIN 150.

5. A positive displacement valveless pump as set forth in claim 1 having a roller bearing supporting said follower pin in the pump housing, said roller bearing having an outer race which is press fitted into a pump housing formed bore.

6. A positive displacement valveless pump as set forth in claim 5 in which a motor drive shaft extends into a bore formed at an axial end of said rotary cam, the length of the bore being greater than the displacement of the pump piston and the diameter of said bore providing a predetermined clearance between the periphery of the drive shaft and the bore to prevent drive shaft vibration.

7. A positive displacement pump comprising:

(a) housing means containing a rotating cam and a rotary-reciprocating piston, each of said cam and said piston having an axis of rotation and said axes extending substantially parallel to each other, a cylinder in said housing means, said piston being mounted to reciprocate in said cylinder to form a variable volume pumping chamber, and an inlet and outlet in said housing communicating with said pumping chamber;

(b) a rotary driveshaft, coupling means connecting said rotary driveshaft to said rotary cam to rotate said cam;

(c) an annular endless groove located on the periphery of said rotating cam, a follower pin attached to said housing and extending into said annular groove to effect reciprocating movement of said rotary cam; and (d) a self-aligning connection between said rotary cam and said piston, said self-aligning connection being located adjacent said rotational axes to allow for radial movement between said rotational axes, said self-aligning connection comprising a radially extending recess in one end of said piston, and a radially extending pin located in said recess and connected to said rotary cam.

* * * * *